US005662592A

United States Patent [19]

Brady

[11] Patent Number: 5,662,592

[45] Date of Patent: Sep. 2, 1997

[54] VERTICAL LEG STRETCHING APPARATUS

[76] Inventor: Thomas L. Brady, 54 Wakefield St., Hamden, Conn. 06512

[21] Appl. No.: 505,077

[22] Filed: Jul. 21, 1995

[51] Int. Cl.[6] ..... A61H 1/02

[52] U.S. Cl. ..... 601/34; 601/23; 482/139; 482/907

[58] Field of Search ..... 482/95, 96, 131–134, 482/139, 907, 148; 601/23, 24, 33–35; 606/241

[56] References Cited

U.S. PATENT DOCUMENTS

| | | | |
|---|---|---|---|
| 5,092,588 | 3/1992 | DeLuca | 482/44 |
| 5,232,427 | 8/1993 | Paro | 482/148 |
| 5,277,681 | 1/1994 | Holt | 482/138 |
| 5,405,306 | 4/1995 | Goldsmith et al. | 482/907 |
| 5,480,375 | 1/1996 | La Foss et al. | 482/907 |

FOREIGN PATENT DOCUMENTS

| | | | |
|---|---|---|---|
| 3718643 | 12/1988 | Germany | 482/907 |

*Primary Examiner*—Jeanne M. Clark
*Attorney, Agent, or Firm*—Evelyn M. Sommer

[57] ABSTRACT

A leg stretching apparatus for a user in a standing position has a base, a pair of upright bars, a leg rest member slidably engaged between the upright bars for movement between selected vertical positions for stretching posterior leg muscles of a user's leg rested thereon, and a linear drive mechanism fixed to the base provided with a drive motor and a linear drive member having an end coupled to the leg rest member. The linear drive member is operated to raise and lower the leg rest member in the vertical direction in a cycle of stretching, holding, and retracting as desired by the user.

3 Claims, 1 Drawing Sheet

VERTICAL LEG STRETCHING APPARATUS

FIELD OF THE INVENTION

This invention generally relates to an apparatus for therapeutic stretching of the leg muscles of an individual, and particularly to a motor-driven orthopedic device that provides a full range of stretching for the posterior muscles of the leg.

The increasing number of people involved in regular physical exercise has led to a corresponding increase in the number of sports-related injuries, particularly to the hips, legs, and lower joints. This, in turn, has led to a greater number of people seeking physical therapy for treatment of these injuries. It is common knowledge that stretching tight muscles is one of the most important means of treating athletic, neurological, or orthopedic injuries to the legs. Stretching helps promote increased or renewed flexibility, increases the range of motion and therefore minimizes the chances of re-injuring the injured limb.

In addition, many athletes require muscle conditioning during training. It is recognized that proper stretching before and after prolonged periods of exercise will increase athletic performance, help prevent injury, and keep sore muscles from tightening.

It is important that proper stretching techniques be used in order to achieve the maximum benefits and prevent injury to the muscles during the stretching process. In order to achieve the maximum benefits, stretching should be done in a slow, gradual fashion, with the limb stretched only so far as it can go without discomfort. The stretch should be maintained at the maximum level for a few seconds and then the tension relaxed. This should then be repeated several times for the maximum benefit. It is important that the stretch be maintained without the individual bouncing, which can itself cause injuries. Proper leg stretching requires that the muscles of the lower back be kept as stable as possible. This avoids straining the lower back and focuses on the limb involved.

BACKGROUND ART

Various types of devices have been proposed for stretching the leg muscles of an individual. For example, a machine having a pair of leg carriages which can be controllably inclined for a user lying in a supine position is disclosed in my co-pending U.S. patent application Ser. No. 08/205,120, filed Mar. 3, 1994, entitled "Method and Apparatus For Stretching Tight Muscles", which is incorporated herein by reference.

SUMMARY OF THE INVENTION

The prior devices have been designed to operate with the user in a sitting or lying position. However, for certain types of leg muscle conditioning or rehabilitation of leg injuries, I have found it desirable to have the user in a standing position so that the proper tensioned relationship of back, buttock, hip, and leg muscles can be utilized during the leg stretching.

In accordance with the present invention, a leg stretching apparatus for a user in a standing position comprises a base, a pair of upright bars having lower ends fixed to the base and upper ends extending in a vertical direction, a leg rest member aligned horizontally between the upright bars having opposite ends slidably engaged therewith so that the leg rest member can be slidably moved between selected vertical positions for stretching posterior leg muscles of a user's leg rested thereon, and a linear drive mechanism fixed to the base provided with a drive motor and a linear drive member having an end coupled to the leg rest member, said linear drive member being extendable and retractable in the vertical direction by operation of the drive motor for moving the leg rest member between selected start and end positions.

The apparatus can be used to move the user's leg through a full range of stretching. The ranges of start and end positions may be varied by attaching extension tubes of different lengths to the drive member. The upper end of the range is selectively determined by the user who actuates the linear drive to push the leg rest member to the limit of comfortable stretching. Other objects, features and advantages of the invention are described below in conjunction with the following drawings.

DETAILED DESCRIPTION OF THE INVENTION

Figure 1:
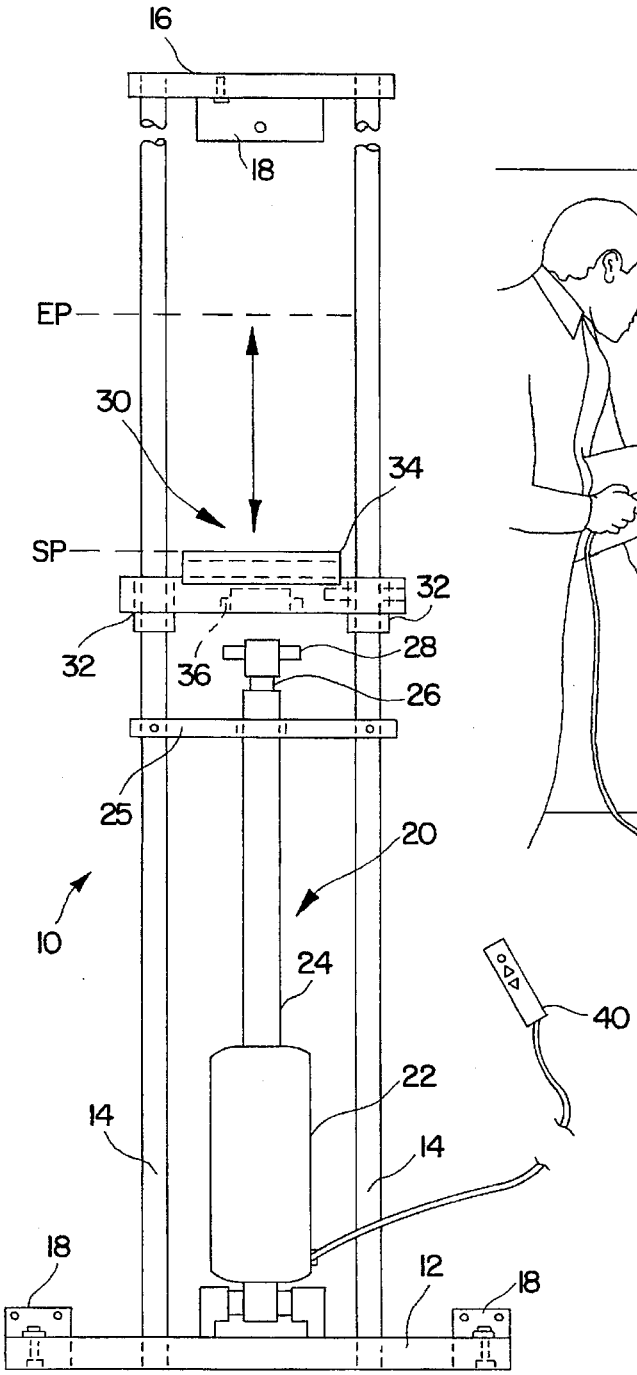
FIG. 1 is elevational front view of an embodiment of the leg stretching apparatus in accordance with the invention.

Referring to FIG. 1, a leg stretching apparatus 10 for a user in a standing position has a base 12 and a pair of upright bars 14 having lower ends fixed to the base 12 and upper ends extending in a vertical direction terminating in an end member 16. The base 12 and end member 16 may be anchored to a back wall by L-shaped brackets 18 for stability. A linear drive actuator 20 is arranged between the upright bars 14 having a motor module 22 mounted to the base 12, a drive rod tube 24 held in place between the upright bars by a bracket 25, and a linear drive rod 26 telescoped in the tube 24 having an end with a keyed head 28 which is driven reciprocatingly in the vertical direction between a start position SP and an end position EP. A leg rest member 30 is aligned horizontally between the upright bars and has bushings 32 by which its opposite ends are slidably engaged on the upright bars 14 so that the leg rest member 30, which is preferably formed as a rest pad for the foot, can be driven by the linear drive rod 26 between the start and end positions SP and EP.

The overall height of the apparatus is chosen to accomodate the height of the typical range of users. The start position SP can be changed by attaching extension tubes of different lengths to the end 28 of the drive rod, e.g., lengths of 13.75", 25.75", or 33". The end position EP is determined by controlling the movement of the leg rest member 30 to the limit of comfort in stretching, up to a maximum of the full rod length. A soft pad 34, made of a foam material for example, can be seated over the top of the leg rest member 30 for the comfort of the user, and a keyed slot 36 can be formed in the bottom of the leg rest member for securely holding the keyed end 28 of the linear drive rod 26.

The operation of the drive motor 22 is controlled by a hand-held controller 40 which is electrically coupled by a cord, or may be a wireless device with a transmitter element. The controller can have up and down control buttons and safety switch. The linear drive actuator may be a conventional type, for example, having a 24 VDC motor with permanent magnets, high strength plastic housing, steel piston rod, self locking in any shut off position, a maximum thrust of 225 ft.-lbs., and a stroke length of about 16".

Figure 2:
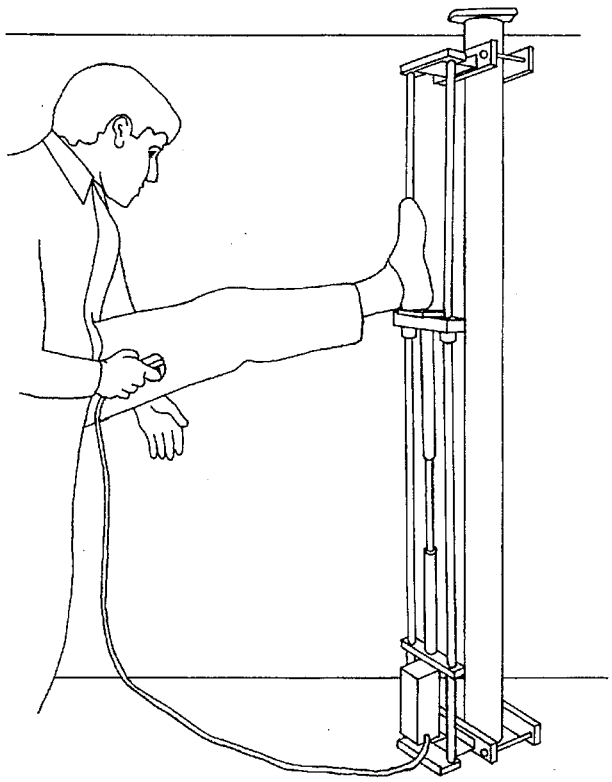
FIG. 2 depicts the manner of proper use of the leg stretching apparatus.

As shown in FIG. 2, the leg stretching apparatus is used by having the user positioned on one leg in a standing position with the ankle or foot of the other leg resting on the foot pad 30 at the start position SP (drive rod 26 fully retracted). Preferably, the knee of the leg to be stretched is kept at full extension, although any degree of knee flexion may also be appropriate. From the start position SP, the user begins to raise the foot pad by operating the UP button on the hand-held controller, which causes the linear drive actuator to raise the foot pad at a controlled rate of speed. The user may raise the foot pad to any desired height where the user can experience stretching of the soft tissue along the posterior leg, particularly the hamstring muscles. The foot pad ascent is stopped by releasing the UP button on the hand-held controller. The user may hold this position, raise the foot pad further, or may lower the unit by pressing the DOWN button. The cycle of stretch/hold/retract may be repeated as desired by the user.

For the assembly shown, the foot pad height elevates from about 23.0" to 36.5" when used without a tube extension. When a small tube extension is used, the foot pad height ranges from 36.5" to 49.5". When a medium tube extension is used, the foot pad height ranges from 48.5" to 62.5", and for a large tube extension ranges from 56.5 to 70.0". The tube extension is selected according to the height of the user and the extent of flexiblity.

Although a preferred embodiment has been described, it will be appreciated that other variations and modifications may be made in accordance with the principles disclosed herein. The invention and such variations and modifications within the scope and spirit thereof are defined in the following claims.

I claim:

1. A leg stretching apparatus for a user in a standing position, comprising a base, a pair of upright bars having lower ends fixed to the base and upper ends extending in a vertical direction, a leg rest member aligned horizontally between the upright bars having opposite ends slidably engaged therewith so that said leg rest member can be slidably moved between selected vertical positions for stretching posterior leg muscles of a user's leg rested thereon, and a linear drive mechanism fixed to the base which is positioned vertically below the leg rest member and between the lower ends of the pair of upright bars and is provided with a drive motor and a linear drive member having an end coupled to the leg rest member, said linear drive member being extendable and retractable in the vertical direction by operation of the drive motor for moving the leg rest member between selected start and end positions, wherein said linear drive member has an end with a keyed head and said leg rest member has a keyed slot for securely holding the keyed head of the linear drive member, and further wherein an extension tube of selected length is attachable to the end of said linear drive member for varying the range of the start and end positions.

2. A leg stretching apparatus according to claim 1, wherein said leg rest member has bushings at its opposite ends for sliding movement on the upright bars.

3. A leg stretching apparatus according to claim 1, wherein said leg rest member has a foot pad seated on its upper portion for resting the user's foot thereon.

* * * * *